United States Patent [19]

Hosono

[11] Patent Number: 4,500,195

[45] Date of Patent: Feb. 19, 1985

[54] IMAGE FORMING APPARATUS AND A UNIT DETACHABLY USED IN THE SAME

[75] Inventor: Nagao Hosono, Chofu, Japan

[73] Assignee: Canon Kabushiki Kaisha, Tokyo, Japan

[21] Appl. No.: 575,080

[22] Filed: Jan. 30, 1984

Related U.S. Application Data

[63] Continuation of Ser. No. 321,077, Nov. 13, 1981, abandoned.

[30] Foreign Application Priority Data

Nov. 22, 1980 [JP] Japan ..... 55-165069

[51] Int. Cl.[3] ..... G03G 15/00

[52] U.S. Cl. ..... 355/3 R; 355/3 DR

[58] Field of Search ..... 355/3 DR, 3 R, 11, 133, 355/14 R, 3 TR, 3 DD

[56] References Cited

U.S. PATENT DOCUMENTS

| | | | |
|---|---|---|---|
| 4,025,178 | 5/1977 | Yokozawa et al. | 355/3 R |
| 4,032,229 | 6/1977 | Tani et al. | 355/3 DR X |
| 4,076,402 | 2/1978 | Kanno et al. | 355/3 DR |
| 4,116,556 | 9/1978 | Tanaka et al. | 355/3 TR X |
| 4,203,386 | 5/1980 | Blöchl et al. | 355/3 DD X |
| 4,286,861 | 9/1981 | Matsumoto et al. | 355/3 R |
| 4,325,626 | 4/1982 | Murata et al. | 355/3 DR |
| 4,327,992 | 5/1982 | Babicz | 355/3 DR X |
| 4,437,757 | 3/1984 | Komori et al. | 355/3 DR X |

*Primary Examiner*—A. C. Prescott

*Attorney, Agent, or Firm*—Fitzpatrick, Cella, Harper & Scinto

[57] ABSTRACT

For an image forming apparatus operable according to the electrographic method or magnetic recording method, it is proposed to form, as respective detachable units, some components of the apparatus for the purpose of easy exchange of wasted and consumed parts, multiple-purpose utilization of the main apparatus and simplification of maintenance. The present invention is a development of this idea. According to the invention there is provided such detachable unit which has in itself a function to change all or a part of the image forming conditions required to the main apparatus to which the unit is to be incorporated. When the unit is mounted into the main apparatus, data of characteristics of the unit and image forming condition suitable for the selected application of the apparatus can be set automatically. Since the unit itself has a part useful for setting the necessary image forming conditions, it is no longer necessary for the serviceman or the operator to do troublesome works for change of conditions and adjustment of the apparatus every time of unit exchange. A desired image can be obtained at once after mounting the unit into the main body of apparatus.

36 Claims, 18 Drawing Figures

IMAGE FORMING APPARATUS AND A UNIT DETACHABLY USED IN THE SAME

This is a continuation of application Ser. No. 321,077, filed Nov. 13, 1981 now abandoned.

BACKGROUND OF THE INVENTION

1. Field of the Invention

The present invention relates to an image forming apparatus to which the known electrographic method or magnetic recording method is applied, for example, a copying machine or a recording or printing apparatus. The present invention relates to also a detachable unit for use in such image forming apparatus.

2. Description of the Prior Art

Hereinafter, the conception of the present invention will be described with reference to an electrophotographic copying machine as an example of the image forming apparatus pertinent to the present invention.

In an electrophotographic copying machine, the photosensitive medium deteriorates with time or is occasionally damaged. Therefore, it requires replacing the used photosensitive medium with a new one. After exchange of the photosensitive medium, however, sometimes the tone of image of the copy made by the new photosensitive medium is different from that of the copy made by the old one. This is caused by differences in sensitivity, charging characteristic, residual potential characteristic etc. These differences are attributable, for instance, to the date of manufacture of the two photosensitive mediums. If they were manufactured on different days, it is quite possible that the mixture ratio of materials for forming the photoconductive layer and/or the physical and chemical treatment conditions for forming the same employed for the new photosensitive medium were slightly different from those employed for the old one. In such case, it is no longer possible to obtain a good image by the new photosensitive medium under the same conditions of amount of corona charge, amount of original exposure etc. as previously set for the old one as optimum.

Therefore, until now it was required to read just the previously set image forming conditions such as the amount of charge and the amount of exposure at the time of photosensitive medium exchange. However, such adjustment of the image forming conditions generally requires a special knowledge about it and an unskilled user can hardly set the necessary image forming conditions. This applies also to such case where the photosensitive medium is contained in a unit which can be mounted on and demounted from the main apparatus aiming at the simplification of exchange.

As a development of the idea of a detachable unit for an image forming apparatus, there is a thought that the main apparatus may be used for many different purposes making full use of the common part. However, if an exchange of such unit is done only with the intention of using different types of developing devices of the two units for different purposes, it will produce only a limited effect for use in multiple-application. Furthermore, the advantage of using such unit is minimal if process change and other adjustments are required each time a unit is mounted on the main apparatus.

SUMMARY OF THE INVENTION

Accordingly, it is an object of the invention to solve the problem involved in mounting detachable image forming means onto the main body of the apparatus.

It is another object of the invention to provide an image forming apparatus which enables an unskilled person without any special knowledge about the apparatus to exchange the wasted and consumed parts and components of the apparatus for new ones and in which the image forming conditions most suitable for the new parts and components can be set automatically.

It is a further object of the invention to provide an image forming apparatus which is able to consistently produce good and stable images without the aid of experts.

To attain the above objects according to the invention, the detachable unit is composed of at least an image bearing member and a part for setting the image forming conditions on the main apparatus according to the purpose for which the unit is used and/or according to the characteristics of the image bearing member. Therefore, the unit may include a part of an image forming means or a plural number of components of image forming means to be arranged around the image bearing member in addition to the image bearing member and the condition setting part. When the unit is mounted onto the main apparatus, the condition setting part received in the apparatus automatically determines the image forming conditions under which the apparatus should form images on the image bearing member. The structure of the condition setting part varies unit by unit depending on the characteristics of the image bearing member contained in the unit and/or depending on the purpose for which the unit is used. For example, if all of the units have the same characteristics of the photosensitive medium and are to be used for the same purpose, then they have the same structure in the condition setting part. According to the invention, therefore, it is only an exchange of the unit which must be done by the operator. The image forming conditions suitable for the unit then used are automatically set without any expert's aid.

Other and further objects, features and advantages of the invention will appear more fully from the following description taken in connection with the accompanying drawings.

DETAILED DESCRIPTION OF PREFERRED EMBODIMENTS

First prevention of a change of image quality caused by characteristic differences between photosensitive mediums will be described in detail with reference to the accompanying drawings.

Figure 1:
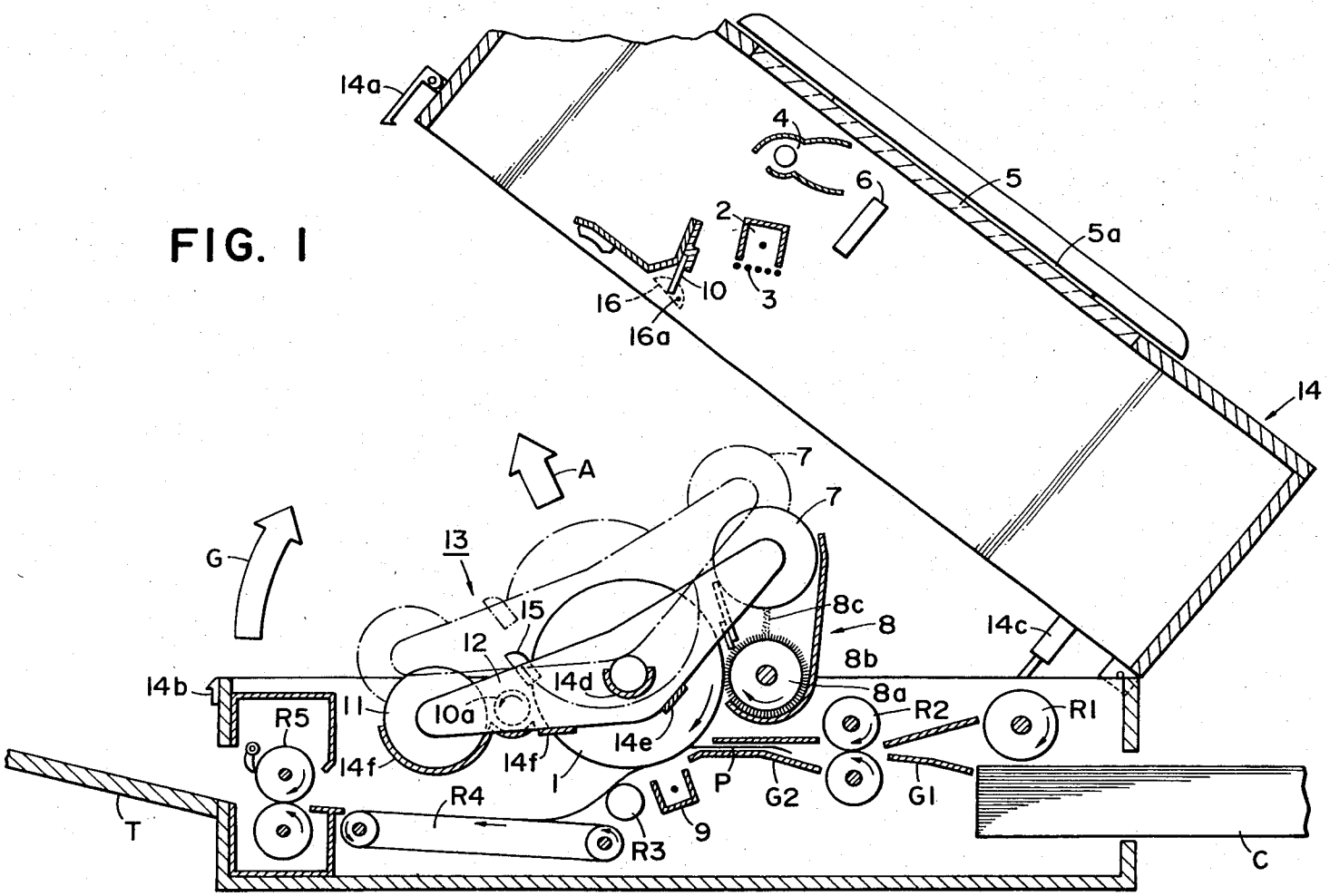
FIG. 1 is a sectional view of an electrophotographic copying machine in which the present invention is embodied.

FIG. 1 shows an electrophotographic copying machine to which an embodiment of the present invention has been applied. The main body of the apparatus comprises an upper body part 14 and a lower body part. The upper body part 14 can be turned around one end of the apparatus relative to the lower body part to open the apparatus. FIG. 1 is a sectional view of the apparatus with the upper body part 14 being opened relative to the lower body part.

Designated by 1 is a photosensitive drum having a cylindrical shape. The photosensitive drum is made of aluminum or other suitable material and has a layer of photoconductive material such as Se applied on the cylindrical surface. The drum 1 is driven into rotation in the direction of the arrow. When used for image formation, the upper body part 14 is closed and fixed in the closed position. The surface of the photosensitive drum 1 is uniformly charged by a corona charger 2 having a grid 3. Reference numeral 5 depicts an original table of transparent glass on which an original 5*a* is placed and covered by an original cover which holds the original in position. The original 5*a* is illuminated by an illumination lamp 4. The image of the illuminated original is slitwise focused on the drum 1 at the area downstream of the corona charger through a short focal length lens array 6. Thus, there is formed on the drum an electrostatic latent image corresponding to the original image.

The electrostatic latent image formed on the drum 1 is developed by a developing device 8. The developing device 8 is fixed to the lower body part of the apparatus. The developing device 8 comprises a developing roller 8*a* with fibrous fur implanted in the surface of the roller. Toner 8*c* is supplied to the developing roller 8*a* from a toner supply cartridge 7. This toner supply is effected by making a predetermined amount of toner fall down from the opening of the cartridge 7 and interlock with the rotation of the photosensitive drum 1. The developing roller 8*a* rotates at the same peripheral speed as the drum to develop the electrostatic latent image into a toner image.

The toner image thus formed on the drum 1 is transferred onto a transfer material P with the aid of a transfer corona charger 9. The transfer material P is fed from a cassette C through a feed roller R1 and guided to the drum surface by guides G1, G2 and a conveying and timing roller R2. After transferring, the transfer material P is discharged by the action of a discharge roller R3 and separated from the drum surface. Thereafter, the transfer material P is transported to a fixing roller R5 by a conveyor belt R4. The toner image on the transfer material P is fixed by the fixing roller R5 and then exited from the main body of the apparatus into a tray T.

On the other hand, after transferring, the drum enters a cleaning station where the toner remaining on the drum surface is cleaned off by a cleaning blade 10 fixed on the upper body part. The toner scraped from the drum surface is conveyed to a toner recovery container 11 by a conveying member 10*a*.

In this embodiment, the toner supply cartridge 7 and the toner recovery container 11 are supported, together with the photosensitive drum 1, by an arm 12 so as to form a unit 13. The unit 13 is detachably mounted on the lower body part of the apparatus in a determined position and fixed in the position in a manner as described later.

The unit 13 can be dismounted from the main apparatus to exchange it for a new unit 13*a* in the following manner:

To lock the upper and lower body parts in the closed position there is provided a pair of locking members 14*a* and 14*b* engageable with each other. By disengaging the locking member 14*a* from the locking member 14*b*, the upper body member 14 is lifted by the action of a spring contained in lifting means 14*c* up to the opened position shown in FIG. 1. After opening the apparatus, the operator lifts up the arm 12 by his hands in the direction of arrow A. The unit 13 constituted of the photosensitive drum 1, toner cartridge 7 and toner recovery container 11 supported all together by the arm 12 can be removed from the main apparatus as suggested by a phantom line in FIG. 1.

Figure 2:
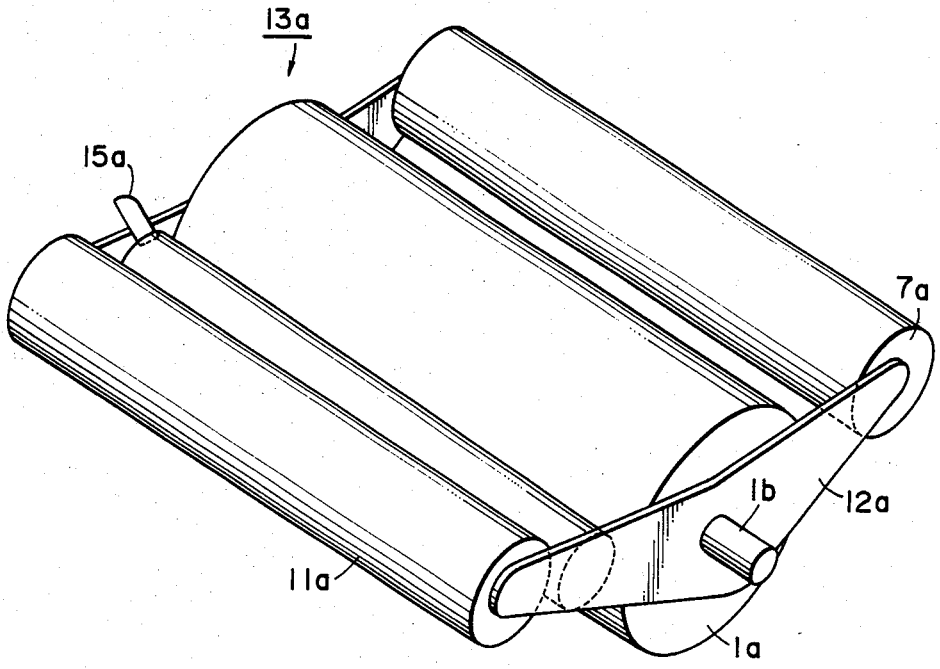
FIG. 2 is a perspective view of a unit containing a photosensitive drum.

After removing the unit 13, a new unit 13*a* as shown in FIG. 2 can be mounted onto the apparatus. The new unit 13*a* is also composed of a photosensitive drum 1*a*, a toner cartridge 7*a* and a toner recovery container 11*a* supported all together by an arm 12*a*. 1*b* is a drum shaft for supporting the drum 1*a*. The drum shaft 1*b* is rotated together with the drum 1*a* and is freely rotatable relative to the arm 12*a*.

In this embodiment, the arm 12*a* has a condition setting part for setting the most suitable image forming conditions (parameters) for the photosensitive drum 1*a* taking into consideration various conditions of the drum 1*a*, such as photosensitivity, charging characteristic and residual potential characteristics thereof. As previously noted, this condition setting part is an essential part of the unit according to the invention. A rod-like member 15*a* provided on a portion of the arm 12*a* (see FIG. 3) constitutes the condition setting part in the shown embodiment. The rod-like member 15*a* is so formed as to drive a member 16 provided on the main body of the apparatus. The member 16 serves to rotate a volume of an image forming condition adjusting circuit in the main apparatus.

At the time of delivery of the unit from the factory, the characteristics of the photosensitive drum such as photosensitivity and charging characteristic are measured. The rod-like member 15*a* fixed on the arm 12*a* with a certain inclination of a certain projection relative to the arm. The inclination or projection of the rod-like member relative to the arm is determined depending on the measured values of the drum characteristics. The rod-like member 15*a* is fixed on the arm 12*a* by means of a screw or bonding agent in the appropriate position to the measured characteristics of the photosensitive drum 1*a*.

In a manner as will be described in detail later, the volume on the side of the main body is rotated by the rod-like member in a specific number of rotations corresponding to the inclination or length of the rod-like member to set the optimum amount of charge and/or the optimum amount of exposure proper to the measured characteristics of the photosensitive drum in the unit.

Mounting of the new unit 13*a* on the main apparatus is carried out in the following manner:

The operator fits both ends of the drum shaft 1*b* slidably into the bearings 14*d* provided on the lower body part and connects the drum shaft 1*b* to a driving source (not shown) in the main apparatus. Thus, the drum 1*a* is rotatably received in the main apparatus in the determined position. At the same time, the arm 12*a* of the unit 13*a* is brought into contact with receiving members 14*a*, 14*f* provided also on the lower body part. By the receiving members 14*a*, 14*f*, the arm 12*a* is correctly positioned and held in position. Also, the cartridge 7*a* and the recovery container 11*a* are held in their proper positions at the same time. The rod-like member 15*a* is fixed in position with a determined inclination or the determined length of projection relative to the main apparatus. After completing the mounting of the unit, the operator turns the upper body part 14 in the direction opposite to the arrow A, namely counter-clockwise, to close the upper and lower body parts, and then locks the apparatus in the closed position by means of the locking member 14*a*, 14*b*. In closing the apparatus, the top end of the rod-like member 15*a* comes into contact with the volume rotation member 16 rotatable about a pin 16 fixed on the upper body part 14. With further downward movement of the upper body part, the rod-like member 15*a* rotates the volume rotation member 16 clockwise by an angle of $\theta$ corresponding to the set inclination angle and projection length of the rod-like member 15*a*.

Figure 3:
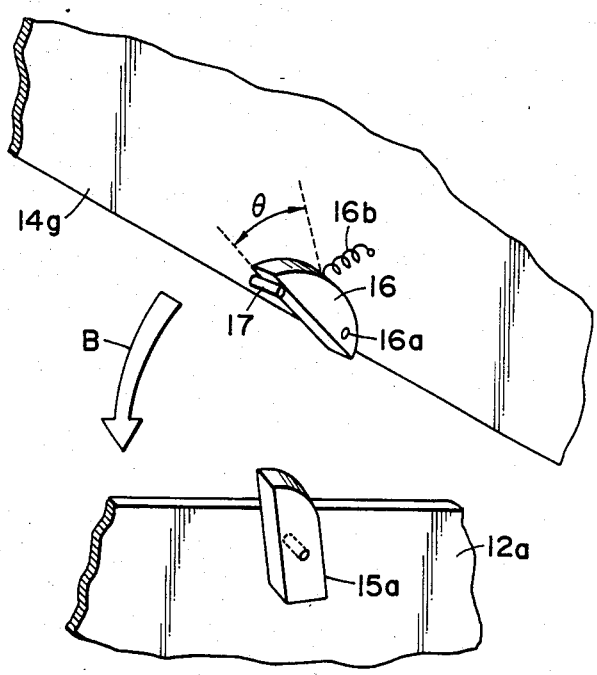
FIG. 3 is a perspective view of a part of the unit including the positioning member.

FIG. 3 illustrates the details of the volume setting mechanism operable with the turn-down of the upper body part 14.

In FIG. 3, reference numeral 14*g* designates a stationary side plate of the upper body part 14. The volume rotation member 16 is mounted on the stationary side plate 14*g* for rotation about the axis 16*a*. Designated by 16*b* is a compression spring, one end of which is fastened to the volume rotation member 16 and the other end is secured to the side plate 14*g*. The compression spring 16*b* biased the volume rotation member 16 against a stopper 17. When the upper body part 14 is rotated counter-clockwise, that is, in the direction of arrow B to close the apparatus and is locked in the closed position, the rod-like member 15*a* provided on the arm 12*a* pushes up the volume rotation member 16 and rotates it by an angle of $\theta$ against the biasing force of the spring 16*b*. After closing the apparatus, therefore, the volume rotation member 16 is held in the position rotated by $\theta$. When the operator rotates the upper body part 14 in the direction of arrow G to open the main apparatus, the volume rotation member 16 is disengaged from the rod-like member 15 and therefore it is allowed to return to its starting position on the stopper 17 by the biasing force of the spring 16*b*. While the rod-like member 15 has been shown to be a separate member afterwards fixed to the unit, the rod-like member may be formed integrally with the unit, for instance, by shaping a portion of the unit into a projection.

Figure 4:
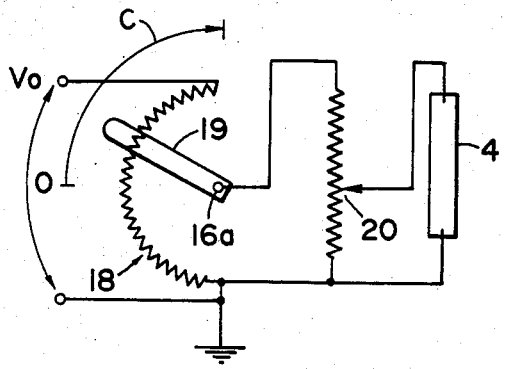
FIG. 4 is an electric circuit diagram showing an example of automatic adjustment of the voltage of an exposure source.
Figure 5:
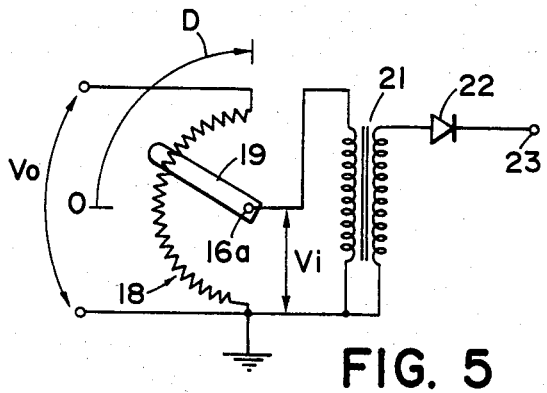
FIG. 5 is an electric circuit diagram showing an example of automatic adjustment of the voltage of a charger.

How to set the image forming conditions suitable for the photosensitive drum within the unit by the above volume will be described hereinafter with reference to FIGS. 4 and 5. FIG. 4 illustrates an example of automatic adjustment of the image forming conditions according to the invention where the change of latent image caused by unit exchange is corrected by changing the amount of exposure on the photosensitive drum 1 while adjusting the applied voltage to the exposure lamp 4 (FIG. 1). FIG. 5 illustrates another example of automatic adjustment where the necessary correction is performed by changing the applied voltage to the corona charger 2.

In the circuits shown in FIGS. 4 and 5, a slide contact member 19 is slideably movable on a slide resistance 18 in link with the rotation of the volume rotation member 16. The voltage then generated is controlled by the slide movement of the slide contact 19 on the resistance 18. To this end, in the shown two examples, the slide contact member 19 is mounted on the same axis 16*a* as the rotation aixs of the volume rotation member 16. With this arrangement, therefore, the slide contact member 19 is rotated on the slide resistance 18 in the same amount of rotation as that of the volume rotation member 16. In the shown examples, the circuit is fixed on the inside of the stationary side plate 14*g*, that is, on the side opposite the side on which the volume rotation member 16 is provided.

When the volume rotation member 16 is rotated by the rod-like member 15 of the unit 13 mounted on the apparatus in the manner described above, the slide contact member 19 is also rotated slideably the slide resistance 18 by an angle of rotation determined by the rod-like member 15 which was in turn preset in accordance with the measured characteristics of the photosensitive drum within the unit. A predetermined constant voltage Vo is being applied to both ends of the slide resistance 18. With the rotation of the volume rotation member 16, the slide contact member 19 rotates in the direction of arrow C (FIG. 4) or D (FIG. 5) starting from the initial position 0 which corresponds to the starting position of the volume rotation member 16 in which the latter is in contact with the stopper 17.

As previously mentioned, the circuit shown in FIG. 4 is a circuit for adjusting the voltage to be applied to the exposure lamp 4 to a value as determined by the normal quantity of light of the photosensitive drum 1*a* then mounted on the apparatus. Designated by 20 in a potentiometer by which the operator controls the amount of exposure from the main apparatus side at the time of actual copy making operation. This control by means of the potentiometer 20 is carried out based on the operator's judgement of the original density. With the arrangement of the control circuit shown in FIG. 4, the voltage of lamp 4 can be adjusted automatically by the rotation of the slide contact member 19 on the slide resistance 18 in a determined angle (FIG. 3) by the rod-like member 15*a* of the mounted unit 13. Thus, it is possible to automatically set the most suitable amount of exposure light for the photosensitive drum 1*a* then used.

The circuit shown in FIG. 5 is a circuit for adjusting the voltage to be applied to the corona wire or grid 3 of the charger 2 to a value determined by the rod-like member 15*a* of the mounted unit 13. Designated by 21 is a transformer and 22 is a rectifier. The input voltage Vi varies, depending on the position of the slide contact member 19. Therefore, a desirable voltage set by the rod-like member 15*a* can be applied to the corona wire or grid 3 of the charger 2 from the output terminal 23 of the circuit. Thus, the voltage applied to the corona charger is automatically adjusted according to the characteristics of the photosensitive drum of the unit 13 then mounted on the apparatus.

Figure 6:
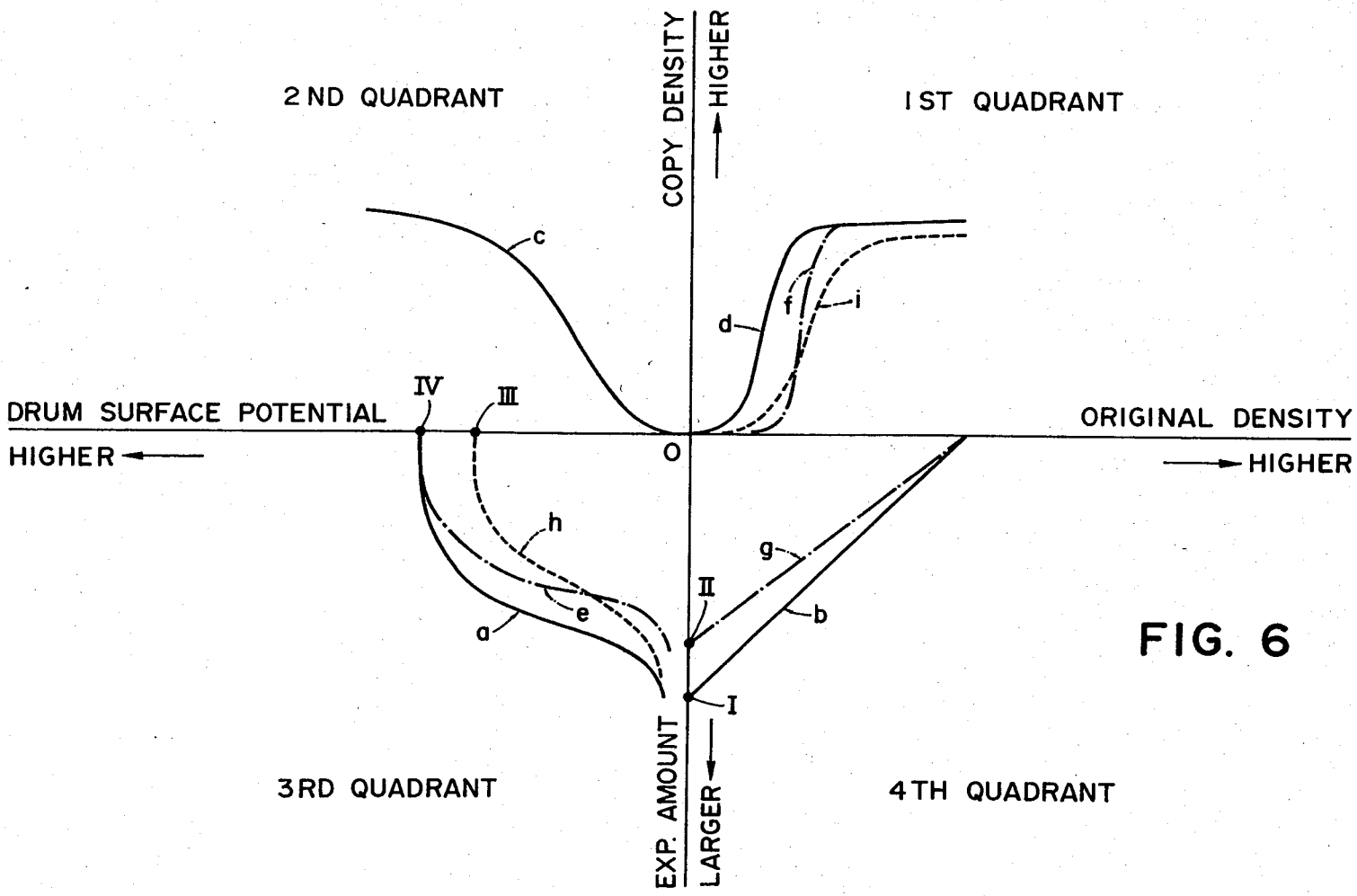
FIG. 6 is a quadrantal chart relating to the respective steps showing the photosensitive drum-copy gradation reproducibility characteristic.

FIG. 6 is a quadrantal chart relating to the respective steps of operation showing the characteristic of photosensitive drum-copy reproducibility.

In FIG. 6, the first quadrant shows the relation between the image density on the original and the toner density on the photosensitive drum, the second quadrant shows the relation between the drum surface potential and the toner density, that is, the developing characteristic and the third quadrant shows the relation between the exposure amount and the drum surface potential which is indicative of the characteristic of the photosensitive medium within the unit. The forth quadrant shows the relation between the original density and the exposure amount on the photosensitive medium.

Differences in the characteristics of the photosensitive drum results in a difference in quality of the formed image. Such variation of image quality must be minimized to obtain good images of stable quality irrespective of differences in characteristics between photosensitive drums. According to the invention, the object of stabilizing image formation can be attained by changing the exposure amount or the amount of charge. An example of such stabilization will be described hereinafter with reference to characteristic curves shown in FIG. 6.

In FIG. 6, the curve a is a characteristic curve of a standard photosensitive drum. A unit containing the standard photosensitive drum was mounted on a copying machine. An original was exposed to light in an amount of exposure indicated by the curve b and then the formed latent image on the photosensitive drum was developed with toner using a developing device of developing characteristic c. After developing there was obtained on the drum a toner image as indicated by the curve d.

The unit was removed from the copying machine and a new unit containing a photosensitive drum of the characteristic curve e was mounted on the same copying machine. If an image is formed on the new photosensitive drum while maintaining the same image forming conditions as above, then there is obtained a toner image as indicated by the curve f. This image is unsatisfactory because the contrast of the toner image is too high to reproduce the halftone of the original. Namely, the halftone is lost in the produced toner image.

To eliminate the problem, the maximum exposure amount must be shifted from the point I to II in FIG. 6 so as to obtain the exposure amount of the curve g. According to the invention, this necessary change of exposure amount from curve b to g is automatically done by the rod-like member in the manner described above with reference to FIG. 4 when the new unit is mounted on the copying machine. Since the image forming condition is automatically adjusted only by mounting the new unit on the copying machine, there is obtained on the new drum a toner image having a characteristic nearly equal to the curve d obtained by the standard photosensitive drum.

Further, the above unit was dismounted from the copying machine and a new unit was mounted on the machine. This new unit contained therein a photosensitive of the characteristic curve h. An image formation was carried out on the photosensitive drum while employing the standard exposure amount of the curve b and maintaining the amount of corona charge at the same level as above. The toner image obtained was too thin in density and too low in contrast as indicated by the curve i. To adjust the image forming conditions to the characteristics of the new photosensitive drum, the corona charge was increased by the above mentioned rod-like member of the unit without changing the amount of exposure so as to shift the maximum drum surface potential from point III to IV in FIG. 6. Thereby, satisfactory toner images were obtained which exhibited almost the same characteristics as that of the curve d.

As readily understood from the above example, the present invention enables formation of consistently stable images in a simple manner by a rod-like member provided on the unit to automatically set the optimum process conditions.

Figure 7:
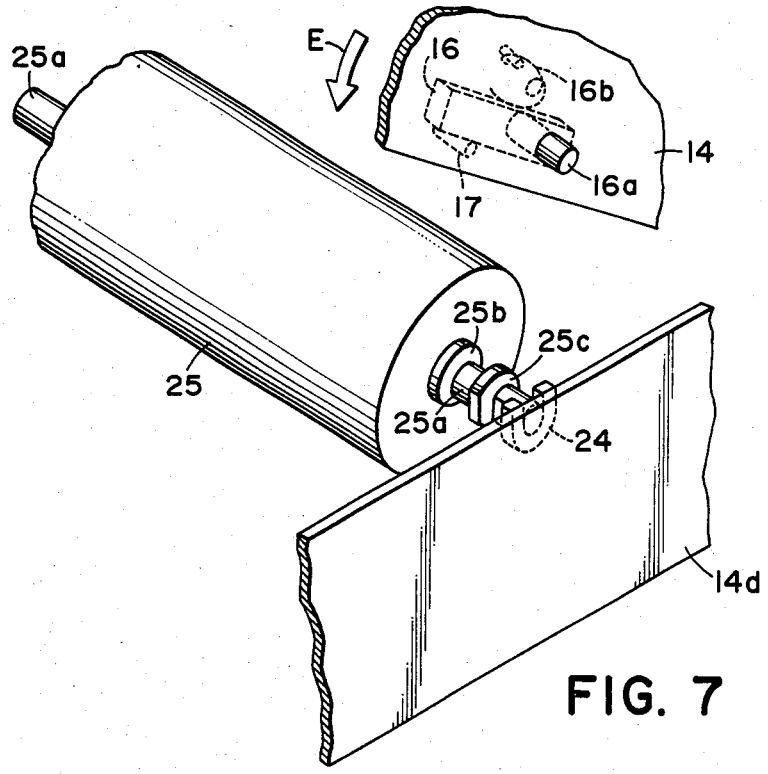
FIG. 7 is a perspective view of a condition setting part showing another example of automatic adjustment by mounting the drum on the apparatus.

FIG. 7 shows another embodiment of the invention.

In the above described embodiment, a photosensitive drum and components around the drum have been supported altogether by an arm 12 to form a detachable unit according to the invention. The second embodiment of the unit shown in FIG. 7 is different from the first embodiment in that the unit constitutes only a photosensitive drum and an image forming condition setting part.

Referring to FIG. 7, a photosensitive drum 25 is mounted on a shaft 25*a* rotatably through a bearing 25*b*. To receive the drum shaft, the lower body part of the apparatus has a bearing 24. On the end portion of the drum shaft 25*a* there is an arcuate projection member 25*c*. The member 25*c* is a separate member from the shaft 25*a* and is fitted onto the shaft fixedly. This arcuate projection member 25*c* functionally corresponds to the rod-like member 15*a* shown in FIG. 3. The projection member 25*c* has a projection height determined according to the characteristics of the photosensitive drum 25 such as sensitivity. The end of the drum shaft 25*a* is partly cut so that the cut end can always be tightly fitted into the bearing 25 in the same direction. Therefore, when a photosensitive drum is mounted on the main apparatus, the projection member 25*c* fitted on the drum shaft 25*a* is oriented in the determined direction relative to the main apparatus. The drum 25 received in the bearing 24 is connected to a driving source (not shown) of the main apparatus. In this mounted position, the drum 25*a* can rotate relative to the shaft 25*a*.

After mounting the drum on the main apparatus in this manner, the operator turns the upper body part 14 downwards as indicated by arrow E to close the apparatus. During the downward movement of the upper body part, the volume rotation member 16 comes into contact with the projection member 25*c* and finally the volume rotation member is rotated clockwise by the projection member 25*c* in the same manner as described above in connection with the first embodiment shown in FIG. 3. The amount of rotation of the volume rotation member 16 corresponds to the size of the projection member 25*c*. Similar to the above embodiment, the slide contact member 19 (see FIGS. 4 and 5) rotates and interlocks with the rotation of the volume rotation member 16 to automatically set the image forming conditions most suitable for the characteristics of the photosensitive drum then mounted.

Figure 8:
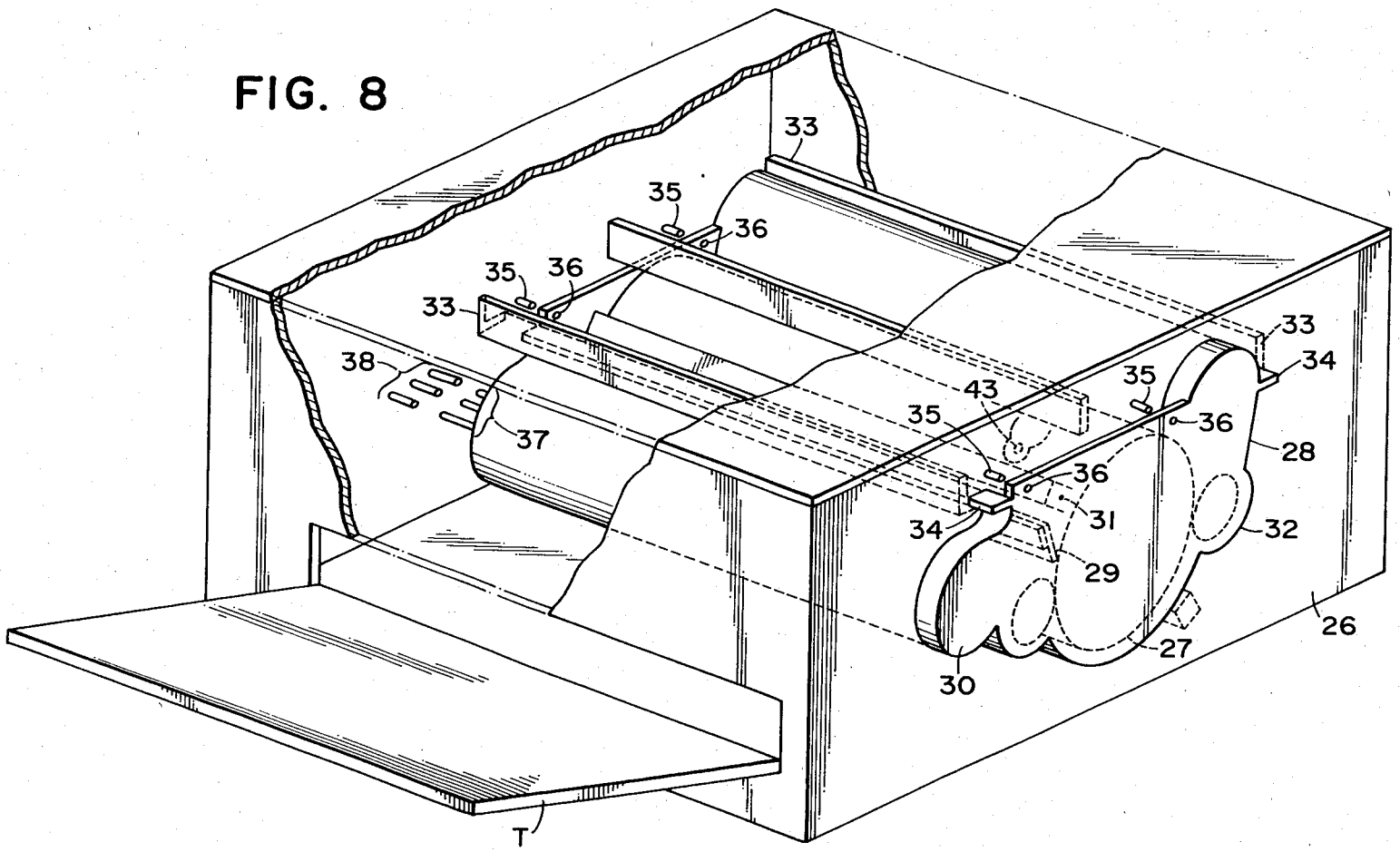
FIG. 8 is a perspective view of a copying machine to which another embodiment of the invention is applied.
Figure 9:
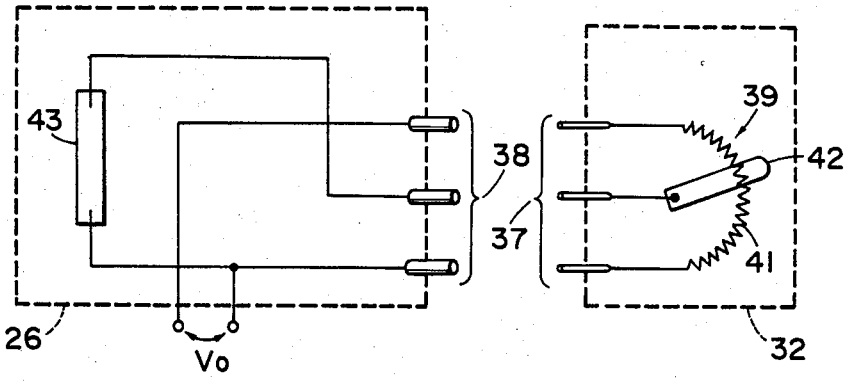
FIG. 9 is an electric circuit diagram showing a further example of automatic adjustment.

A further embodiment of the detachable unit according to the invention is shown in FIGS. 8 and 9.

This embodiment is applicable also to the type of copying apparatus which cannot be opened vertically although the above embodiments have been applied to the vertically openable copying machine. Furthermore, while the above embodiments have been so formed as to set the image forming condition by means of a mechanical connection in the style of a cam, this embodiment is so formed as to use an electrical connector for forming a selected condition setting circuit.

The structure of the copying machine shown in FIG. 8 is substantially the same as that of the copying machine shown in FIG. 1 except that the main body of the apparatus shown in FIG. 8 is not divided into two parts and therefore cannot be opened vertically.

In this embodiment, a photosensitive drum 27, a developing device 28, a cleaning device 29, a toner recovery container 30 and a charger 31 are assembled together into a unit 32. The unit 32 can be detachably mounted on the main apparatus 26. The main body has a guide 33 and the unit 32 has a rail 34. In mounting the unit on the main apparatus, the rail 34 is engaged with the guide 33 on the main body and then the unit is slideably moved into the main body along the guide 33. Positioning of the unit relative to the main apparatus is performed by inserting a pin 35 on the main body side into an opening 36 on the side of unit 32.

In this embodiment, the automatic process condition setting, according to the present invention is performed in the following manner:

The unit 32 has plug pins 37 provided on the forward end as viewed in the direction of the unit being inserted into the main body of the apparatus. The main body has jacks 38 corresponding to the plug pins 37. When the unit 32 is inserted into the main apparatus, the plug pins 37 are also inserted into the jacks 38 and an electric circuit is formed thereby to automatically set the image forming conditions necessary for the mounted unit 32. To this end, the unit 32 is provided with a volume resistance 39 as shown in FIG. 39. The volume resistance 39 comprises a slide resistor 41 and a slide contact 42 on the slide resistor. To set the optimum image forming conditions for the characteristics of the photosensitive drum 27, a resistance value is selected by the slide contact 42. In the selected position, the slide contact 42 is fixed immovably by means of a bonding agent or the like. This fixing of the position of slide contact 42 may be done before the delivery of the photosensitive drum from the factory.

With the above arrangement, the voltage applied to the exposure lamp 43 can be automatically adjusted to a value determined by the resistance value preset at the volume resistance 39 when the plug pin 37 is plugged into the corresponding jack 38 on the main apparatus in mounting the unit on the apparatus. Therefore, the work to be done by the operator in exchanging one unit for another is only to mount the selected unit on the main apparatus. The optimum amount of exposure or pre-exposure for the mounted unit is automatically set by the plug pin 37 used for forming an electric connection between the unit and the main apparatus. The lamp to be adjusted automatically in the above manner is never limited to the image exposure light source (lamp 4 in FIG. 1) only. It may be also a pre-exposure lamp used for exposing the photosensitive drum 27 to light before charging it by the charger 2.

According to the embodiments described above, good and stable quality images can always be obtained even when the characteristic of the photosensitive drum varies from one unit to another unit every time a unit is exchanged. The image forming conditions suitable for every unit can be set automatically according to the characteristics of the photosensitive drum contained in the unit then mounted on the main apparatus. The operator need not conduct adjustment after mounting the unit on the main apparatus.

It is to be understood that various modifications are possible in the above embodiments. For example, two or more image forming conditions such as charge amount and exposure amount may be automatically set at the same time according to the invention by providing two or more volume members and two or more corresponding rod-like members or connectors.

The condition setting member contained in the unit may be mechanical means such as a cam or electrical means such as an electric connector. Also, there may be used known optical reading means for the same purpose. In this case, instruction signals for setting the necessary image forming conditions are written on the surface of every unit in the form of bright and dark picture signals. Said optical reading means reads the information signal mark on the unit. To read such information signal written on the unit, magnetic reading means may also be used. In these cases, the optical information mark or magnetic memory means, such as a magnetic plate, constitutes the condition setting part of the unit according to the invention.

Figure 10:
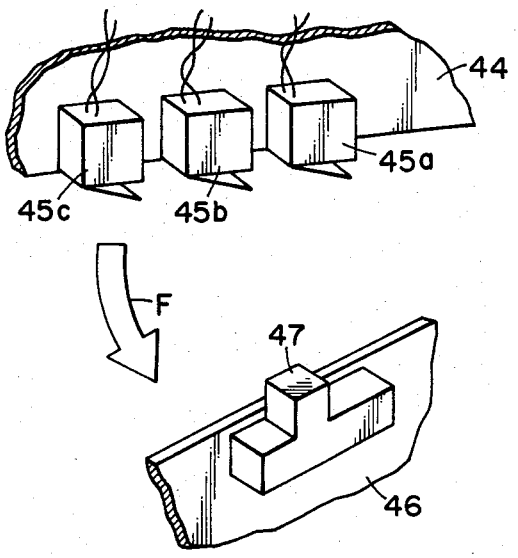
FIG. 10 shows a further embodiment of the condition setting part.

FIG. 10 shows another form of the image forming condition setting part of the unit. This is a modification of the embodiment shown in FIG. 3.

Designated by 44 is a side plate fixed on the upper body part. Push button switches such as microswitches 45*a*, 45*b* and 45*c* are arranged on the side plate 44 at equal intervals. 46 is an arm constituting the unit. 47 is a separate projection member which is fixed on the arm 46 at a determined position corresponding to the switch 45. To fix the projection member on the arm there may be used a bonding agent or other bonding means. The position of the projected portion of the member 47 is selected according to the characteristics of the photosensitive drum contained in the unit. The projection member 47 is fixed on the side plate in the selected position. When the operator turns down the upper body member in the direction of arrow F to close the apparatus, the side plate 44 is also moved down and one of the button switches 45 is pushed by the projection 47 to select a determined image forming condition.

Figure 11:
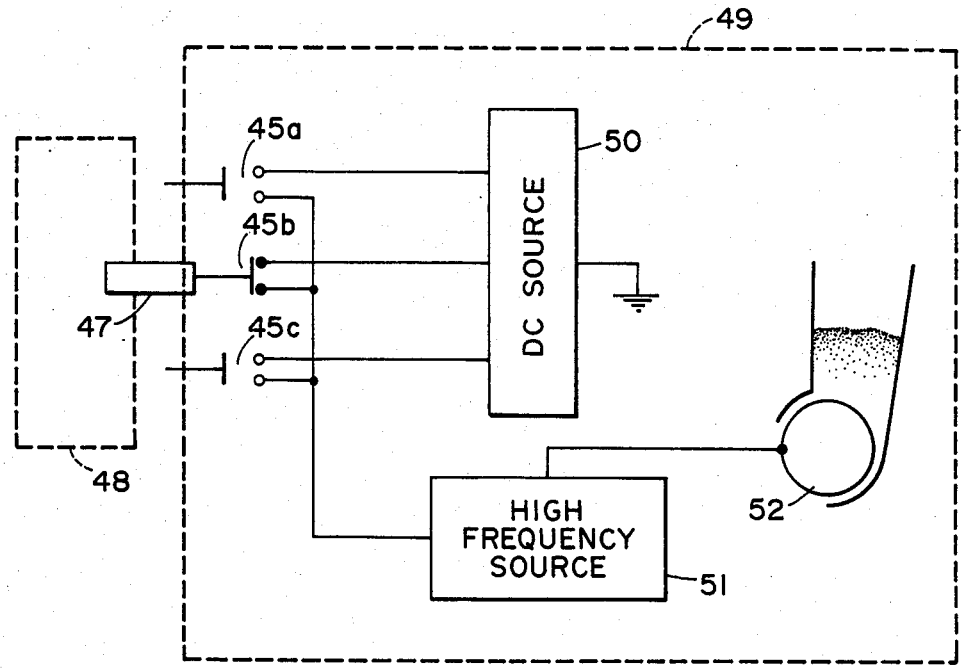
FIG. 11 is a view of the control circuit according to the embodiment shown in FIG. 10.

FIG. 11 shows a control circuit for changing development bias voltage by the above selection of push button switching.

In FIG. 11, reference numeral 48 designates the unit to be mounted on the main apparatus. The unit 48 is mounted on the main apparatus at a determined position in the lower body part. After mounting the unit, the operator moves down the upper body member 49 toward the lower body member to close the apparatus. With this downward movement of the upper body part 49, one of the switches 45, for example, switch 45*b*, is turned On in the manner described above. FIG. 11 shows the control circuit in this position in which the switch 45*b* is On. 50 is a DC source, one output of which is connected to the backside electrode of the photosensitive drum and is grounded. Another output of DC source 50 has three output terminals for three different DC voltages. These three output terminals are connected to three switches 45*a*, 45*b* and 45*c* respectively at one terminal of each of the switches. The other terminal of each switch 45 is connected to one output terminal of a high frequency source 51 (2000 Vpp, 1500 Hz), the other output terminal of which is connected to the developing roller 52 of the developing device. Therefore, when a desired switch 45 is pushed down by the projection member 47, an alternating voltage waveform on which a desired DC voltage is superposed is applied between the developing roller and the drum backside electrode to develop the electrostatic latent image formed on the photosensitive drum.

Since the position of the projection member 47 is preselected according to the characteristics of the photosensitive drum contained in the unit, it is assured that variation of characteristics of the photosensitive drum from one to another can be correctly compensated by the automatically selected development bias voltage proper to the photosensitive drum then mounted on the apparatus. In this manner, even when the characteristic of the now mounted drum is different from that of the previously used drum, there is applied between the developing roller and the drum backside electrode a development bias voltage always appropriate to the drum now mounted, and therefore always good images of stable quality can be obtained.

The following table demonstrates the effect of the above embodiment:

TABLE 1

| Photosensitive drum used | Bright part potential to standard exposure amount [V] | Selected micro-switch | Development bias voltage DC component [V] |
|---|---|---|---|
| A | −50 | 45 c | −150 |
| B | −80 | 45 b | −200 |
| C | −130 | 45 a | −250 |

The experiment from which the above data were obtained was conducted in the following manner:

Three units 48 containing photosensitive drums A, B and C respectively were prepared. The photosensitive drums were formed employing an organic photo semiconductor. These photosensitive drums A, B and C are different in type and have different bright part potentials to a constant standard exposure amount as shown in the above table. Excepting the grounded output terminal, the three output terminals of the DC source 50 were preset to −250 V, −200 V and −150 V respectively. These three terminals were connected to the microswitches 45*a*, 45*b* and 45*c* at their one terminal as shown in FIG. 11.

For every photosensitive drum, a projection member 47 was provided on the unit 48 and the projecting portion of the projection member 48 was suitably positioned considering the characteristics of the photosensitive drum. In all the photosensitive drums A, B and C, an appropriate development bias voltage could be applied to the developing roller when the microswitch 45*c*, 45*b* or 45*a* was turned On by the correspondingly positioned projection member 47. Image formation was carried out in a satisfactory manner for any of the photosensitive drums A, B and C having different image forming characteristics.

Of course, the above embodiment is applicable also to another type of apparatus as shown in FIG. 8 in which the unit is inserted into the main body of the apparatus horizontally. In this case, a group of switches may be arranged on the innermost side of the main apparatus or along the path for insertion of the unit.

By the combination of push buttons and projection part described above a fine adjustment of image forming conditions can be attained. This automatic condition setting method may be used not only to alter the exposure amount but also to set other various image forming conditions, such as the charging condition.

The term "image forming condition" as used herein includes various conditions useful for correcting the characteristic differences between photosensitive mediums and forming stable images. It may be the charging condition relating to a charger such as grid voltage value or applied corona voltage value or the voltage value of a corona charger for transferring the formed image. The voltage of corona charger in latent image forming means and the value of current applied to these corona chargers also may be used as image forming conditions. In the embodiments in which the quantity of light of an exposure lamp is changed according to the invention, the image forming condition may be the amount of pre-exposure or the amount of imagewise exposure. Furthermore, parameters corresponding to the rotation time of the drum for pre-rotation which is carried out before starting the image forming operation, or the amount of exposure during the pre-rotation or the value of pre-charge, may be used as the image forming condition to effect the objects of the invention. Examples of the image forming condition further include the value of development bias voltage, the rotation time of the photosensitive drum after transferring the developed image, the condition of exposure discharging during the post-rotation and the condition of temperature control on the photosensitive drum which is carried out to keep the characteristics of the drum constant.

In the above embodiments, the image forming condition setting member has been used to prevent change in image characteristics caused by the difference in characteristics between one unit and another unit. However, the condition setting member according to the invention may be used for other purposes. For example, it may be used to automatically set an appropriate process sequence to the mounted unit according to the purpose for which the unit is used.

As an example, a monochrome copy only unit and a color copy only unit may be prepared for a common main apparatus. In this case, the image forming condition setting member can be used to automatically set the sequence for monochro copying operation or the sequence for color copying operation at the main apparatus according to the kind of unit then mounted on the main apparatus. If necessary, a compensation for the characteristic change of photosensitive drum may be carried out simultaneously with the automatic setting of the sequence.

An example of such automatic setting of sequence according to the invention will be described hereinafter with reference to FIGS. 12 to 18 and in connection with an electrophotographic copying machine useful for both monochrome copy and color copy.

Figure 12:
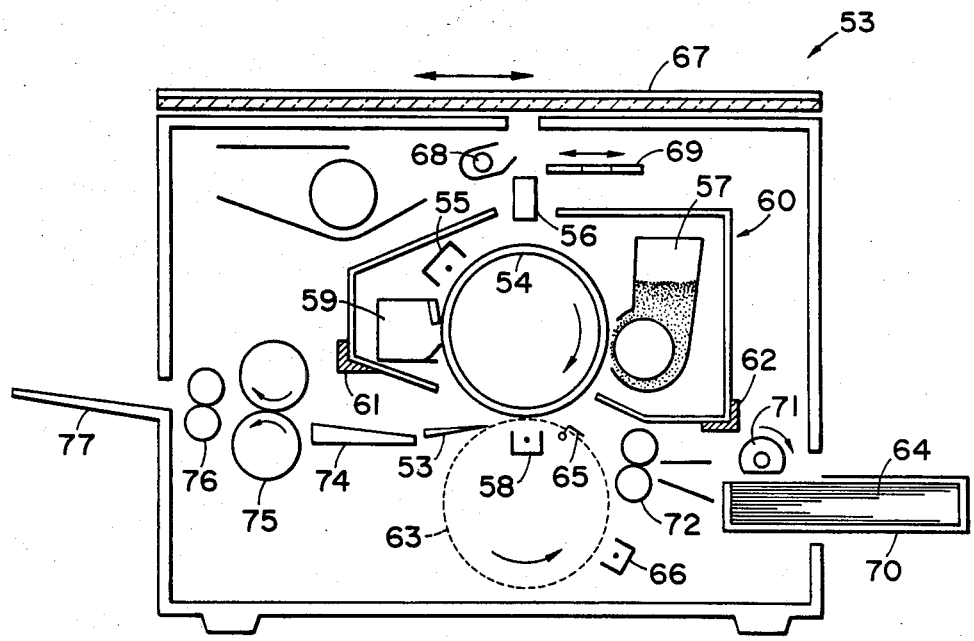
FIG. 12 is a sectional view of a monochro-and-color copying machine to which a further embodiment of the invention is applied.

In FIG. 12 there is shown an electrophotographic copying machine useful for both monochrome copy and color copy which includes a photosensitive drum 54 comprising an electroconductive drum substrate and a photoconductive layer applied on the substrate. The drum 54 is mounted rotatably in the direction of arrow. Around the photosensitive drum 54 there are disposed a corona charger 55, a short focal length optical element array 56, a developing device 57, a transfer corona charger 58 and a cleaning device 59 in this order as viewed in the direction of the drum being rotated. In this apparatus, the drum 54, corona charger 55, developing device 57 and cleaning device 59 are supported together to form a detachable unit 60. In mounting the unit on the main body of the apparatus, the unit 60 is guided and supported by guide rails 61 and 62 fixedly provided on the inside of the main body. The transfer corona charger 58 is disposed within a transfer drum 63 provided in the main body. The circumference of the transfer drum 63 is composed of an insulating network. The transfer drum is provided with a gripper 65 for holding the fore edge of a transfer material 64. In the vicinity of the outer circumference of the transfer drum 63 there is disposed a corona charger 66 for charging the transfer drum to draw the transfer material 64 onto the drum.

In the shown copying machine, the surface of the photosensitive drum 54 is at first uniformly charged with a selected polarity by the corona charger 55. After that, the original placed on the original table 67 moving reciprocally is illuminated by an exposure lamp 68. In the case of color copy, the reflected light from the original is projected on the photosensitive drum 54 through a color separation filter and through the optical array 56 to form a latent image on the drum. The latent image is developed by the developing device 57 and then the developed image is transferred onto the transfer material under the action of the transfer corona charger 58.

The transfer material is fed from a transfer material supply tray 70 by a feed roller 71 and transported to the transfer drum 63 through a pair of timing rollers 72. After transferring, the transfer material is released from the transfer material gripper 65 and then separated from the transfer drum by separation means 73. The separated transfer material is delivered to a fixing device 75 through a guide 74. The developed image on the transfer material is fixed by the fixing device 75. After fixing the transfer material is exhausted from the main body into a discharge tray 77 through a pair of exhaust rollers 76.

Figure 13:
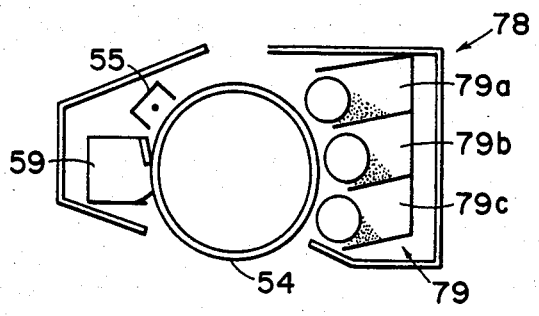
FIG. 13 is a sectional view of a unit which can be mounted in the apparatus shown in FIG. 12.

As previously noted, the operator can mount any one of monochrome copy only unit and color copy only unit on the above described type of the copying machine. The unit 60 mounted on the copying machine shown in FIG. 12 is a unit for black-and-white development only (monochrome copy only unit) containing a black-and-white developing device 57. A unit for color development only (color copy only unit) is shown in FIG. 13. The color copy only unit 78 has the same size as the monochro copy only unit 60 but the unit 78 contains a color developing device 79 in place of the black-and-white developing device 57. As seen in FIG. 12, the color developing device 79 comprises three developing sections, namely yellow developing section 79*a*, magenta developing section 79*b* and cyan developing section 79*c* arranged in this order as viewed in the direction of drum rotation.

For the shown copying machine 53, the monochrome copy only unit 60 and the color copy only unit 78 are interchangeable each other. As previously described with reference to FIG. 8, the unit exchange can be carried out by moving the unit along the guide rails 62, 63 in the direction of the length of the drum shaft.

In such unit exchange it should be noted that the image forming process with the unit 60 and the image forming process with the unit 78 are different from each other. In the case of a black-and-white copy making process, only one cycle of the steps of latent image formation, development, transfer and fixing is required to produce a copy. In contrast, in the case of a color copy making process, before the fixing step, three cycles of the steps of latent image formation with color separation, development and transferring are required to produce a copy. The present invention allows interchangeability of such units which require different processes for a common main apparatus and make the main apparatus operate according to the purpose of which the unit is used. An embodiment of process selecting means according to the invention will be described in detail hereinafter.

Figure 14:
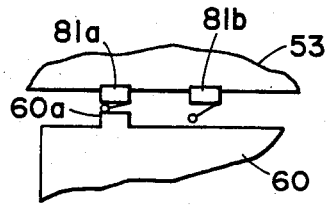
FIGS. 14 and 15 show the relation between the unit and the switch provided on the main body side.
Figure 15:
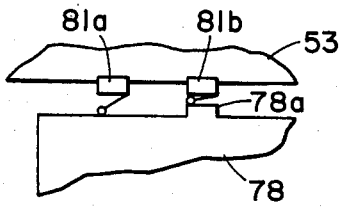

FIG. 14 is a fragmentary plan view showing the monochro copy only unit 60 mounted in the main apparatus 53. FIG. 15 is a view similar to FIG. 14 showing the color copy only unit 78 mounted in the main apparatus 53. The unit 60 has a projection 60*a* and the unit 78 has a projection 78*a*. The position in which the projection 60*a* is provided on the unit 60 is different from that of the projection 78*a* on the unit 78. The main body of the apparatus 53 has two switches 81*a* and 81*b* disposed corresponding to the projection 60*a* and 78*a* respectively. When the unit 60 is mounted onto the main apparatus 53, its projection 60*a* pushes the switch 81*a* to select the process which the unit 60 requires. On the contrary, when the unit 78 is mounted, its projection 78*a* pushes the other switch 81*b* to select the process which the unit 78 requires.

Figure 16:
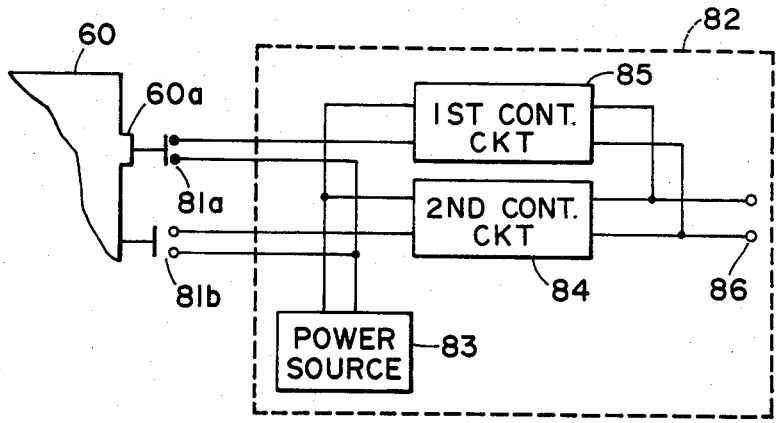
FIG. 16 is an electric circuit diagram showing the manner how to select the circuit by the condition setting part.

FIG. 16 shows an embodiment of control for realizing the process selected by the projection 60*a* of the unit 60 which turns the switch 81*a* On. In this embodiment, the switch selects directly one control circuit.

In FIG. 16, reference numeral 82 designates a control part for operating and driving the respective parts of the apparatus 53. The control part includes a power source 83, first control circuit 84 for driving the apparatus 53 to produce black-and-white copy and second control circuit 85 for driving the same apparatus to produce color copy. The two control circuits 84 and 85 are operable independently of each other. The provision of such two independent control circuits within the control part 82 brings forth the advantage that a high degree of control is possible and that even when one of the circuits is disabled, it is possible to operate the main apparatus by the other circuit.

Figure 17:
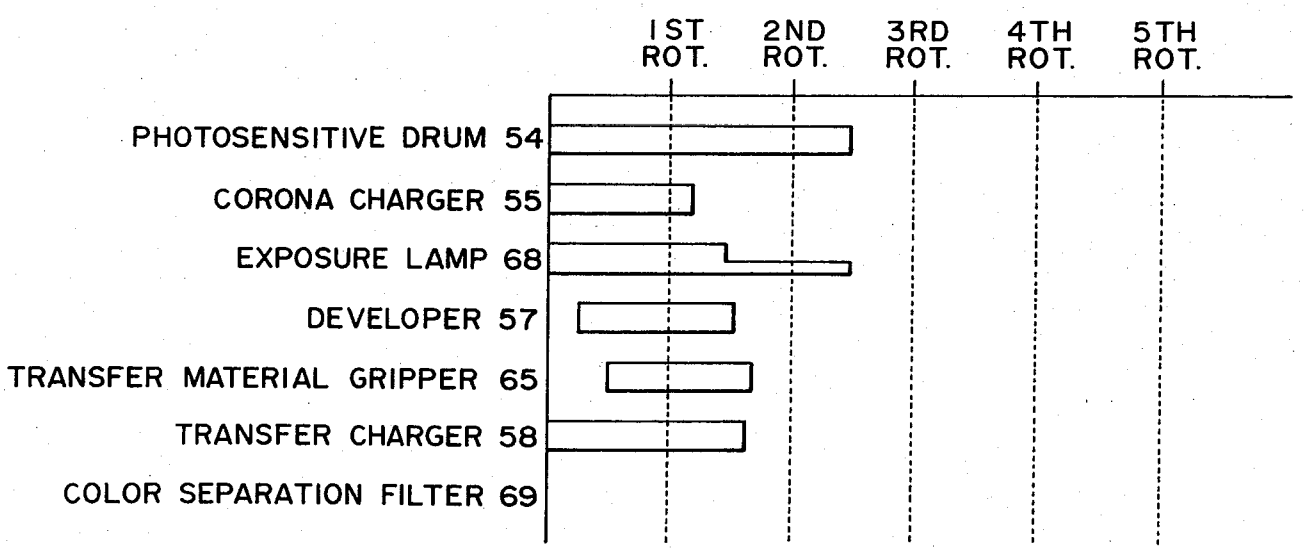
FIGS. 17 and 18 are timing charts illustrating the difference between two processes for different units.

By mounting the unit 60 on the main apparatus 53, the first control circuit 84 is selected and there appears at the output terminal 86 a control signal for black-and-white copy. The apparatus is so controlled as to carry out the black-and-white copy making process the timing chart of which is shown in FIG. 17. The transfer material gripper 65 continues gripping the transfer material only during the time of the toner image on the drum 54 being transferred, that is, only about one revolution of the transfer drum 63.

Figure 18:
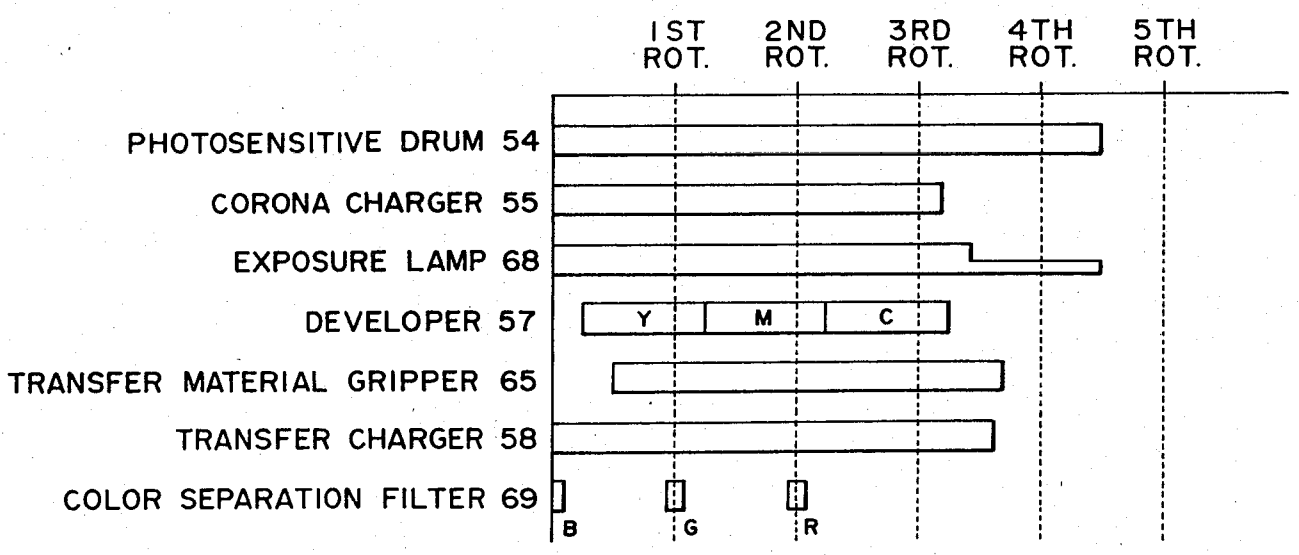

When the color copy only unit 78 is mounted on the main apparatus, the second control circuit 85 is selected in the manner described above and the apparatus is so controlled as to carry out the color copy making process the timing chart of which is shown in FIG. 18. In this process, the color separation filter 59 and the developing segments 79*a*, 79*b*, 79*c* of the developing device are brought into operation. To produce a color copy the following steps are required:

Latent image formation through blue filter, development of the latent image with yellow toner and transferring the toner image onto a transfer material; latent image formation through green filter, development of the latent image with magenta toner and transferring the toner image onto the same transfer material; latent image formation through red filter, development of the latent image with cyan toner and transferring the toner image onto the same transfer material; and releasing the transfer material from the gripper 65 and fixing the final image with the fixing device 75.

As will be understood from the above embodiment, the image forming condition setting part of the unit according to the invention can be used not only to adjust some image forming conditions such as exposure amount and charge amount but also to automatically select the whole process, that is, the sequence of the process. In particular when the control part of the main apparatus includes two independently operable control circuits, the sequence selection in addition to the condition adjustment can be carried out very easily by the condition setting part of the unit according to the invention.

As another example, the condition setting part according to the invention may be used to select positive development or negative development according to the kind of unit then mounted in the main apparatus.

In this case, one unit such as the unit 60 in FIG. 12 is formed as a negative development unit. Another unit of the same size is prepared as a positive development unit (not shown). The negative development unit contains toner of the same polarity as that of the formed latent image whereas the positive development unit contains toner of the opposite polarity to that of the latent image. When the negative development unit is mounted on the main apparatus, a circuit is selected in the manner described above with reference to FIGS. 14–16 so that a bias voltage most suitable for the mounted unit can be applied to the developing device. When the positive development unit is mounted to the main apparatus, another circuit is selected so that such bias can be applied to the developing device which inhibits the deposition of toner on non-latent image portions.

As a concrete control circuit for this embodiment there may be used also a circuit as shown in FIG. 11. The desired bias output can be obtained by turning on one of the switches by the projection of the unit for negative development or positive development.

In this manner, within the scope of the invention, two or more circuits can be selected by the image forming condition setting part of the unit. Therefore, by increasing the number of combinations of circuits, it is possible to automatically select a suitable sequence and also to automatically compensate the variation of image forming characteristics between one image bearing member and another at the same time.

As clearly understood from the foregoing, the present invention has many advantages over the prior art.

According to the invention, an exchange of unit produces no problem. The optimum image forming conditions and/or process for the mounted unit can be set automatically by the unit itself. Therefore a stable interlocking relation can be obtained between the main apparatus and the unit mounted thereon without fail every time. After unit exchange, the operator need not worry about difficult adjustments of the main apparatus. Change-over of the process from black-and-white image formation to color image or vice versa or change-over of developer from two-component developer to one-component developer or vice versa can be accomplished automatically merely by exchanging the unit from one to another. This improves and broadens the function and utility of the main apparatus.

Obviously many modifications and variations of the present invention are possible in the light of the above teachings. It is therefore to be understood that the invention is not limited in its application to the particular embodiments shown in the accompanying drawings and described in detail above. For example, although the present invention has been particularly shown and described in connection with an electrophotographic image forming system in which an electrostatic latent image is formed on a photosensitive medium and then the electrostatic latent image is visualized with developer, the present invention may be applied also to other image forming systems such as the known magnetic image forming system in which a magnetic latent image is formed.

What I claim is:

1. An image forming apparatus, comprising:

a process unit for forming images;

a main assembly having means for actuating said process unit to operate for image formation, wherein said process unit is receivable into said main assembly;

process means provided in said process unit and comprising a photosensitive member and means actable thereon for repetitive image formation, for cooperating with said actuating means of said main assembly to repetitively form an image on an image receiving material; supporting means for supporting said process means as a unit; and means for providing a representation of a property of said process means for use in forming said repetitive images on the image receiving material, effected by the cooperation of the means of said main assembly and said process means within said unit; and control means coupled to said process means for controlling said process means within said unit in accordance with the property representation from said representation means.

2. An apparatus according to claim 1, wherein said actuating means contained in said main assembly, includes means directly actable on said process unit.

3. An apparatus according to claim 2, wherein said directly actable means is directly actable on said photosensitive member within said unit.

4. An apparatus according to claim 2, wherein said actuating means contained in said main assembly, includes means indirectly actable on said unit.

5. An apparatus according to claim 1, wherein said actuating means contained in said main assembly includes means directly actable on said photosensitive member within said unit, and wherein said control means controls said directly actable means.

6. An apparatus according to claim 1, wherein said actuating means contained in said main assembly includes means indirectly actable on said photosensitive member within said unit, and wherein said control means controls said indirectly actable means.

7. An apparatus according to claim 1, wherein said control means indirectly controls said process means within said unit, by controlling said actuating means.

8. An apparatus according to claim 6, wherein said control means controls said actuating means contained in said main assembly and said process means in said process unit.

9. An apparatus according to claim 6, wherein said representation means represents a plurality of properties of said unit.

10. A process unit receivable into an image forming apparatus, comprising:

process means including a photosensitive member and means actable thereon for repetitive image formation, for cooperating with means of the image forming apparatus to repetitively form an image on an image receiving material;

supporting means for supporting said process means as a unit; and means for providing a representation of the process means to provide the image forming apparatus with property information of said process means within the unit for use in controlling the image formation on the image receiving material.

11. A unit according to claim 10, wherein said process means includes means necessary for image formation.

12. A unit according to claim 10, wherein said process means includes all means necessary for image formation.

13. A unit according to claim 10, wherein said representation means represents a quantitive property of said process means within the unit.

14. A unit according to claim 10, wherein said representation means represents a qualitative property of said process means within the unit.

15. A unit according to claim 10, wherein said representation means represents a plurality of properties of the unit.

16. A process unit receivable into an image forming apparatus, comprising:

a casing provided with an imput aperture adapted to receive oncoming light information from the image forming apparatus and an output aperture for providing an image receiving material with an image corresponding to the light information received through said input aperture;

plural process means adapted to cooperate with means provided in the image forming apparatus to form an image on the image receiving material repeatedly; and an element, provided on the casing, for providing a representation of a property of said unit and adapted to cooperate with the image forming apparatus to control the image outgoing through said output aperture onto the image receiving material in accordance with the property represented by said element.

17. An apparatus according to claim 1, wherein said control means includes means for applying a voltage which is different in dependence of the property of said process unit to said actuating means, and said representation means is effective to determine voltage in accordance with the property of said process unit.

18. An apparatus according to claim 17, wherein said control means includes a variable resistor for changing a voltage applied to said actuating means, and said representation means sets the resistance of the variable resistor in accordance with the property of said process unit.

19. An apparatus according to claim 17, wherein said control means includes means for applying at least one of plural voltages to said actuating means, and said representation means selects one of the voltages in accordance with the property of said process unit.

20. An apparatus according to claim 1, wherein said control means is provided in said main assembly.

21. An apparatus according to claim 19, wherein said control means includes a plurality of switches selectively actuable by said representation means in accordance with the property of said process unit.

22. An image forming apparatus, comprising:

a process unit for forming images;

a main assembly having means for actuating said process unit to operate for image formation, wherein said process unit is receivable into said main assembly;

process means provided in said process unit and comprising a photosensitive member and means actable thereon for repetitive image formation, for cooperating with said actuating means of said main assembly to repetitively form an image on an image receiving material; supporting means for supporting said process means as a unit; and means for providing a representation of a property of said process means for use in forming said repetitive images on the image receiving material, effected by the cooperation of the means of said main assembly and said process means within said process unit; and said representation means adapted to automatically set said process means within said unit in accordance with the property representation from said representation means.

23. An apparatus according to claim 22, wherein said representation means includes a resistor provided in said process unit and having a resistance set in accordance with the property of said process unit.

24. An apparatus according to claim 1, wherein said control means effects its controlling action by causing said actuating means of said main assembly to perform a function which is different in dependence of the property of said process unit so that said process means of said process unit functions in a proper manner matched to the property of said process unit.

25. An apparatus according to claim 24, wherein said control means is so coupled to said process means as to effect the controlling action thereof.

26. An apparatus according to claim 3, wherein said actuating means includes a corona discharger actable on said photosensitive member.

27. An apparatus according to claim 3, wherein said actuating means includes sequence control circuits for controlling operation of said process means.

28. An apparatus according to claim 3, wherein said actuating means includes a lamp actable on said photosensitive member.

29. An apparatus according to claim 3, wherein said actuating means includes developing means.

30. An apparatus according to claim 4, wherein said actuating means includes an image transfer corona discharger.

31. An apparatus according to claim 1, wherein said actuating means includes selectably operable plural control circuits, and said representation means actuates voltage to one of said control circuits in accordance with the property of said process unit.

32. A unit according to claim 14, wherein said representation means represents whether the associated unit is for negative image formation or whether it is for positive image formation.

33. A unit according to claim 14, wherein said representation means represents whether the associated unit is for monochromatic image formation or whether it is for multi-color image formation.

34. A unit according to claim 10, wherein said representation means controls, when said unit is received in said image forming apparatus, the image formation performed by the cooperation of said process means and said means of the image forming apparatus.

35. A unit according to claim 34, wherein said representation means includes a register provided in said process unit and having a resistance set in accordance with the property of said process unit.

36. An apparatus according to claim 1, wherein said representation means regulates the power applied to an exposure lamp actable on said photosensitive member.

* * * * *

UNITED STATES PATENT AND TRADEMARK OFFICE

CERTIFICATE OF CORRECTION

PATENT NO. : 4,500,195

DATED : February 19, 1985

INVENTOR(S) : NAGAO HOSONO

It is certified that error appears in the above-identified patent and that said Letters Patent is hereby corrected as shown below:

IN THE ABSTRACT [57]

Line 19, "works" should read --work--.

Line 20, "every time of" should read --for each--.

COLUMN 1

Line 15, "to also" should read --also to--.

COLUMN 3

Line 9, "monochro-and-color" should read --monochroic-and-color--.

Line 25, after "First" insert --,--.

COLUMN 5

Line 1, before "fixed" insert --is--.

Line 58, "biased" should read --biases--.

COLUMN 6

Line 56, "in" should read --is--.

COLUMN 8

Lines 5 and 6, after "photosensitive" insert --drum--.

COLUMN 12

Line 55, "monochro" should read --monochroic--.

Line 59, after "of" insert --the--.

COLUMN 13

Line 4, after "of" insert --the--.

UNITED STATES PATENT AND TRADEMARK OFFICE

CERTIFICATE OF CORRECTION

PATENT NO. : 4,500,195

DATED : February 19, 1985

INVENTOR(S) : NAGAO HOSONO

It is certified that error appears in the above-identified patent and that said Letters Patent is hereby corrected as shown below:

COLUMN 13

Line 59, "monochro" should read --monochroic--.

COLUMN 14

Line 23, "monochro" should read --monochroic--.

Signed and Sealed this

*Seventh* Day of *January 1986*

[SEAL]

*Attest:*

DONALD J. QUIGG

*Attesting Officer*

*Commissioner of Patents and Trademarks*